US005802948A

United States Patent [19]

Andrisin, III et al.

[11] Patent Number: 5,802,948

[45] Date of Patent: Sep. 8, 1998

[54] METHOD FOR SHARPENING CRAYONS

[75] Inventors: John J. Andrisin, III, Cuyahoga Falls; David D. Hayes, Hartville; G. Stewart Lenox, Akron; Robert L. Quinlan, Stow; Douglas Zlatic, North Royalton, all of Ohio

[73] Assignee: The Little Tikes Company, Hudson, Ohio

[21] Appl. No.: 784,691

[22] Filed: Jan. 15, 1997

Related U.S. Application Data

[62] Division of Ser. No. 598,840, Feb. 9, 1996.

[51] Int. Cl.[6] ..... B43L 23/02

[52] U.S. Cl. ..... 83/862; 83/875; 83/880; 30/452; 30/454; 144/28.5

[58] Field of Search ..... 30/451, 452, 454, 30/455, 457, 462, 453; 81/9.51; 83/13, 49, 39, 51–53, 862, 875, 879, 880, 167; 144/359, 363, 28.1, 28, 28.11, 28.2, 28.3, 28.4, 28.5, 28.6, 28.71, 28.72, 28.8, 28.9, 28.7

[56] References Cited

U.S. PATENT DOCUMENTS

| | | | |
|---|---|---|---|
| D. 169,980 | 7/1953 | Knapp | D74/21 |
| D. 170,554 | 10/1953 | Squarcio | D74/21 |
| D. 332,281 | 1/1993 | Silverman | D19/36 |
| 1,920,957 | 8/1933 | Cassini | 120/93 |
| 2,624,316 | 1/1953 | Blanco et al. | 120/93 |
| 2,691,960 | 10/1954 | Leeds et al. | 120/93 |
| 2,857,881 | 10/1958 | Beebe et al. | 120/1 |
| 3,548,691 | 12/1970 | Horrocks | 81/9.5 |
| 3,776,286 | 12/1973 | Blanck | 144/28.5 |
| 3,777,791 | 12/1973 | Uchida | 144/28.72 |
| 3,889,730 | 6/1975 | Buc | 144/28.5 |
| 3,980,113 | 9/1976 | Birdsall | 144/28.6 |
| 4,050,487 | 9/1977 | Mabuchi et al. | 144/28.5 |
| 4,248,283 | 2/1981 | Kaye | 145/3.31 |
| 4,263,348 | 4/1981 | Renegar | 427/286 |
| 4,402,354 | 9/1983 | Halpern | 145/3.5 |
| 4,601,316 | 7/1986 | Verdi | 144/28.72 |
| 4,815,507 | 3/1989 | O'Rourke | 144/28.5 |
| 4,918,816 | 4/1990 | Alpha | 30/452 |
| 4,966,208 | 10/1990 | Uang | 144/28.72 |
| 4,991,299 | 2/1991 | Dietterich et al. | 30/453 |
| 5,002,182 | 3/1991 | McGinnis | 206/214 |
| 5,046,876 | 9/1991 | Boraca | 30/454 X |
| 5,167,071 | 12/1992 | Eisen | 30/452 |
| 5,379,817 | 1/1995 | O'Neil et al. | 144/363 |

*Primary Examiner*—Rinaldi I. Rada
*Assistant Examiner*—Boyer Ashley
*Attorney, Agent, or Firm*—Richard B. O'Planick

[57] ABSTRACT

A crayon sharpening assembly is disclosed comprising an axially rotating cartridge block (106) having an axial bore (178) for axial receipt of a crayon with a forward end of the crayon positioned within a cutting station (152). A pair of convergent sharpening blades (158, 160) carve a conical nose into the forward crayon end; a secondary horizontal blade (180) engages the forward crayon end and cuts an annular stepped shoulder surrounding the conical nose; and a preparatory vertical blade (188) makes a vertical circumscribing cut through the jacket of the crayon proximate the forward end, whereby restoring the forward crayon end into its manufactured form. A carrying case (12, 14) is provided having a pivotal lid (16), with the sharpener drive assembly (20, 22) built into one end wall. A drawer assembly (100) is removable from the end wall and contains the cartridge block (106) and a housing (102) for collecting shavings generated in the sharpening procedure. A bottom housing door (104) opens to allow expulsion of the shavings. Rotation of the cartridge block (106) is facilitated by an electrically driven drive assembly that is automatically engaged and disengaged by the respective insertion and removal of the crayon and disengaged by the removal of the drawer housing assembly. Rotation of the cartridge block (106) is defeated by clutch member (230) whenever an article that has a hardness greater than that of a crayon is inserted into the cartridge block cutting station (152).

7 Claims, 17 Drawing Sheets

METHOD FOR SHARPENING CRAYONS

This Application is a divisional of application Ser. No. 08/598,840 filed on Feb. 9, 1996, currently pending.

BACKGROUND OF THE INVENTION

1. Field of the Invention

The subject invention relates generally to sharpeners for writing or drawing implements and, more specifically, to electric sharpeners for crayons.

2. The Prior Art

Crayon or pencil sharpeners are common consumer products. Typically such devices are designed to be either portable or mounted to a surface in a fixed fashion. The configuration of conventional sharpeners provide a conical block with opposed walls defining an implement receiving channel. The walls provide sharpening edges, of either metallic or plastic composition, that extend from the base of the housing to its apex. The edges engage and shave the surface of the crayon or pencil as the implement is pressed into the opening and rotated.

In regard specifically to crayon sharpeners, the crayon is inserted downward into the conical housing and rotated against the wall edges. The tip of the crayon, formed of wax plastic, or similar material, is shaved layer by layer into a conical form, tapering to a point. The shavings pass through openings between the wall edges into a receptacle below that can be detached and emptied when full. Electric sharpeners are designed to rotate the cutting block while the user holds the writing implement stationary against the cutting edges.

Representative of known sharpeners are the embodiments set forth in U.S. Pat. Nos. 2,857,881; 4,248,283; and 4,991,299. The cutting elements in each are of the type described above. The '881 embodiment is of note for showing a crayon carton that provides a sharpening element in one of the carton sidewalls. The shavings are collected within a separate internal compartment of the carton and emptied by opening one of the carton flaps.

The state of the art sharpeners work well and are widely accepted by their users. However, several shortcomings are attendant their use, particularly in the sharpening of crayons. In order to appreciate the shortcomings, it is important to note that crayons are coloring implements formed by a molding operation into a specific point configuration of plastic or wax, to provide a coloring tip of optimal utility. The form of the tip is frustroconical, tapering downward from a inwardly stepped annular shoulder to a flat circular nose. The flat nose, wider than a point, is more suitable for coloring than a point for it enables a wider band of color to be applied with each stroke. A paper or plastic sleeve is formed to encase the crayon and is either removed by hand prior to sharpening the point or removed by the sharpener during the sharpening procedure.

The molded form of the tip created in the manufacture of the crayon is optimal for its intended use, but quickly deteriorates with use. The post manufacture sharpening of the crayon into a sharp point, as done with prior art sharpeners, however, creates a crayon tip that is inferior to that formed in the original mold. A sharp point will wear down quickly into an undesirable dull round shape. Moreover, a sharp point is much more inefficient in laying a wide band of color with each stroke.

In addition, the paper jacket surrounding the crayon is relatively abrasive to cut when compared to the soft crayon material. Repeated use of known sharpeners against such a jacket can cause plastic cutting blades of conventional sharpeners to dull quickly. Removing the sleeve by hand can eliminate this deficiency but is inconvenient from the user's standpoint.

Another deficiency in available sharpeners, particularly electrically driven versions, is that they lack adequate user safeguards. Since the users of crayon sharpeners are young children, it is important to guard the user from contact with the cutting blades of the sharpener, both during the sharpening procedure and when the shavings receptacle is being emptied. Moreover, safeguards are needed to insure that young users will not damage the crayon sharpener by inserting into the cutting station inappropriate objects that are much harder than crayons, such as pencils or pens. Commercial sharpeners have blades that are relatively difficult to maintain or repair. Lastly, young users are more likely to use sharpeners in such a manner as to cause end portions of the crayon to break off in the cutting station. Available sharpeners neither deter such breakage nor facilitate easy removal of the broken pieces from the cutting station.

SUMMARY OF THE INVENTION

The subject invention overcomes the aforementioned shortcomings by providing a crayon sharpener that restores the crayon tip to its manufactured configuration; facilitates safe and convenient repair and maintenance but reduces the need therefor; and contains safety features that protect young users. In addition, the sharpener incorporates a built-in piece ejection pin for expelling broken crayon tips from the cutting station.

The subject sharpener comprises a carry case having an internal storage compartment for storing crayons and other supplies, and a battery driven crayon sharpener built into one of the carry case sidewalls. The sharpener comprises a fixedly mounted battery and drive gear train and a removable cartridge module. The cartridge module couples to the drive gear train in use and includes a cartridge block having four independently oriented cutting blades and a shaving collecting drawer therebeneath.

The cartridge block has an axial bore therethrough dimensioned to receive a crayon and a pair of conically beveled plastic blades at an inward end of the bore positioned to contact a forward end of the inserted crayon. The motor drive train rotates the cartridge block, causing the plastic blades to impart a conical nose to the forward crayon end and to cut an instepped annular shoulder around the conically formed crayon tip.

A preparatory steel blade is also provided, mounted to the cartridge block and oriented normal to the crayon axis and positioned to contact a forward peripheral surface of the crayon and score the jacket therearound. A secondary steel blade is mounted to the cartridge block and oriented parallel to the axis of the crayon. The secondary blade rotates with the block to peel off and remove the paper covering that was scored by the preparatory steel blade mounted normal to the crayon axis.

An ejector pin is positioned to extend coaxially with the forward end of the cartridge block bore and provides a vertical forward surface that operates to form a flat vertical nose surface on the crayon tip during the sharpening procedure. Combined, the action of the blades and ejector pin forward surface restore the crayon tip to its original manufactured configuration. In addition, the ejector pin is spring loaded by insertion of the crayon into the cartridge block. Upon removal of the crayon, the forward surface of the ejector pin moves into the cartridge block bore to dislodge any broken crayon pieces therein which thereupon fall down into the module drawer.

Automatic motor engagement and disengagement, responsive to insertion of the crayon is provided and the gear train driving the cartridge block is configured to disengage the drive whenever an article harder than a crayon, such as a pencil or pen, is inserted into the cartridge bore. The motor also is disabled whenever the cartridge module is removed from the carry case sidewall. The cartridge module shaving drawer can be readily emptied through a side door and an internal flange within the drawer prevents the user from placing fingers in proximity to the cartridge block blades above the drawer. The blades, however, can be accessed if necessary when the cartridge module is disattached for repair or replacement of the blades.

Accordingly, it is an objective of the subject invention to provide a crayon sharpener that restores the forward tip of a worn crayon to its original configuration.

A further objective is to provide a sharpener that self-ejects broken crayon pieces from the cutting station.

Another objective is to provide a crayon sharpener that provides ready access to cutting blades for maintenance or replacement.

An objective of the invention is to provide a crayon sharpener having automatic drive motor engagement and disengagement responsive to the presence of a crayon.

An objective of the invention is to provide a crayon sharpener that automatically disables the drive motor when a harder implement such as a pen or pencil is inserted into the cutting station.

Yet a further objective is to provide a crayon sharpener having cutting blades of respective material composition.

A further objective is to provide a crayon sharpener having a removable module for blade access and for shavings disposal.

Still a further objective is to provide a crayon sharpener that is made of relatively few parts and that requires a low level of maintenance.

Another objective is to provide a crayon sharpener that is economically and readily produced, readily assembled and that is convenient to the user.

These and other objectives, which will be apparent to those skilled in the art, are achieved by a preferred embodiment that is described in detail below and illustrated in the accompanying drawings.

DESCRIPTION OF THE PREFERRED EMBODIMENT

Figure 1:
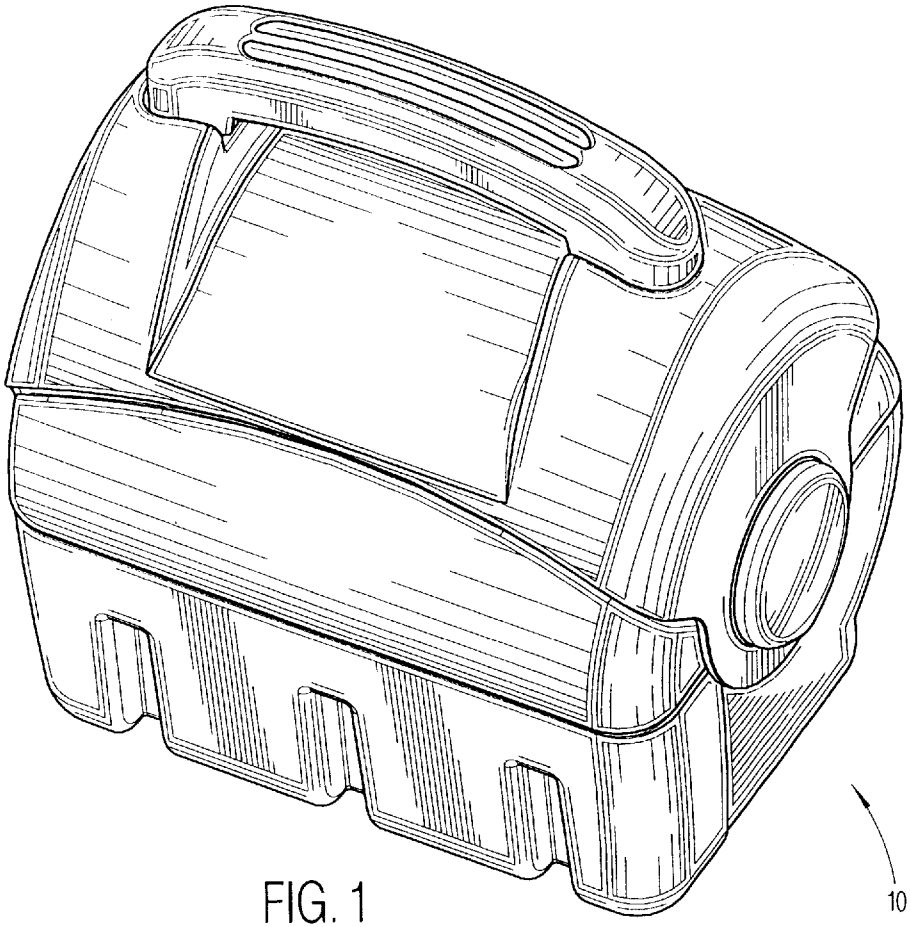
FIG. 1 is a perspective view of the assembled sharpener.
Figure 2:
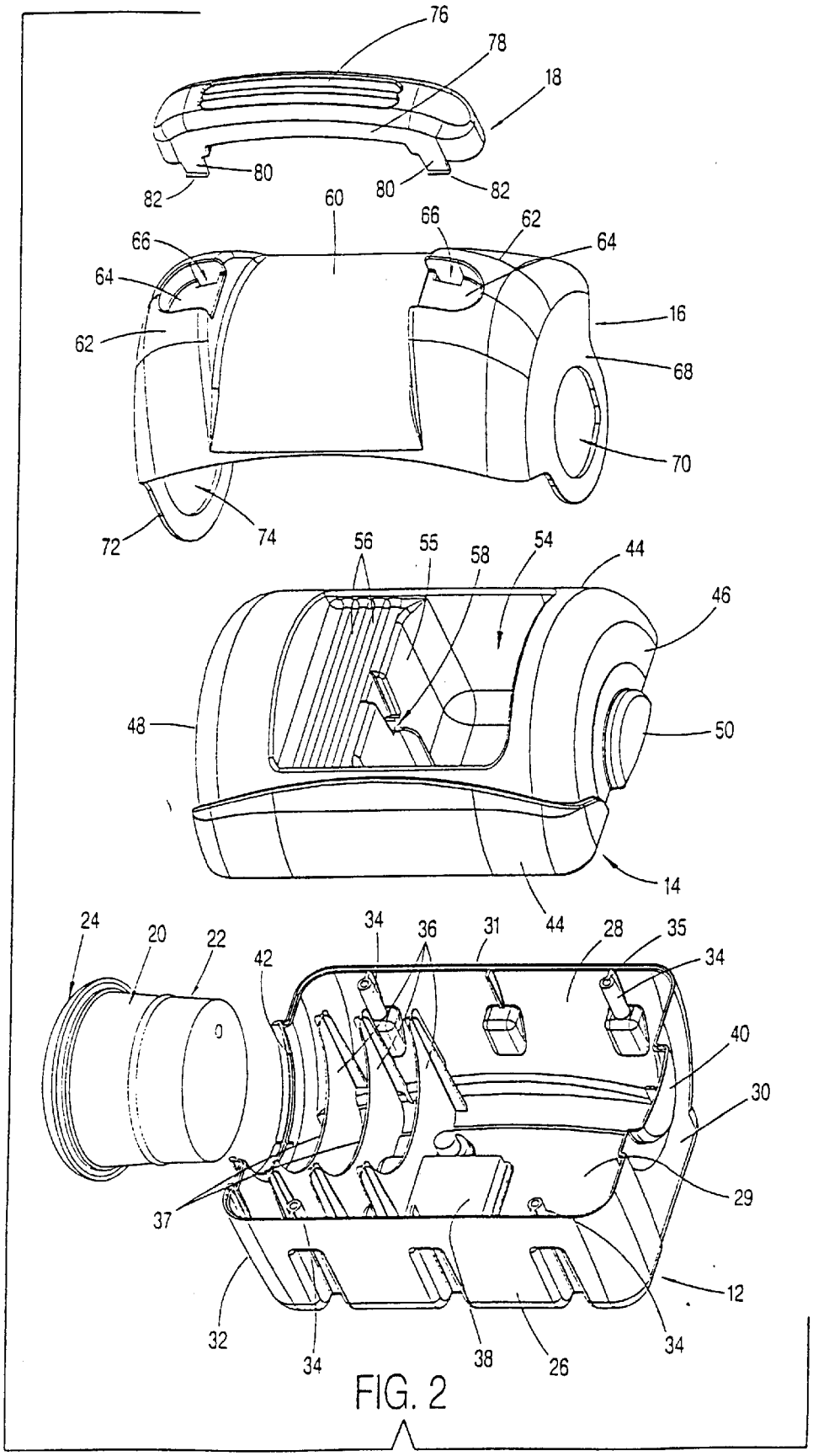
FIG. 2 is an exploded perspective view of the carry case and motor housing.
Figure 3:
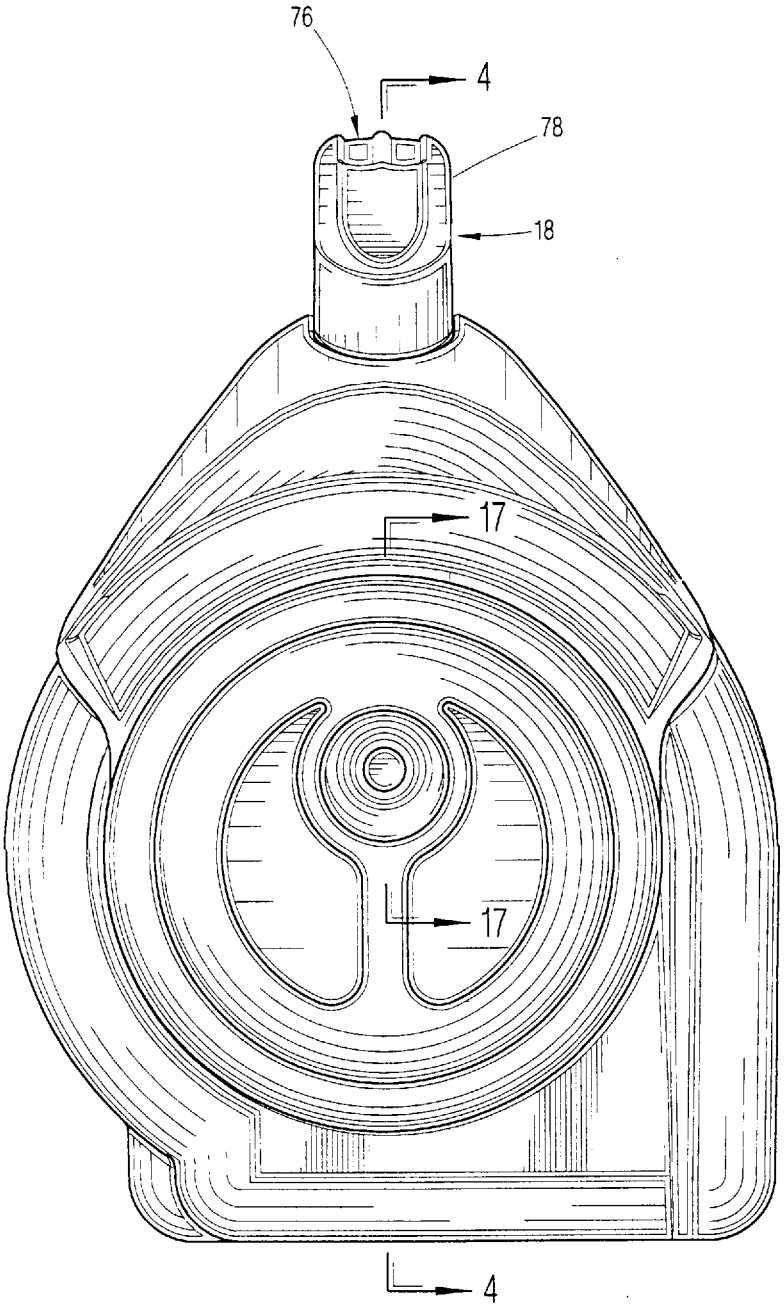
FIG. 3 is a right end elevation view of the assembled sharpener.
Figure 4:
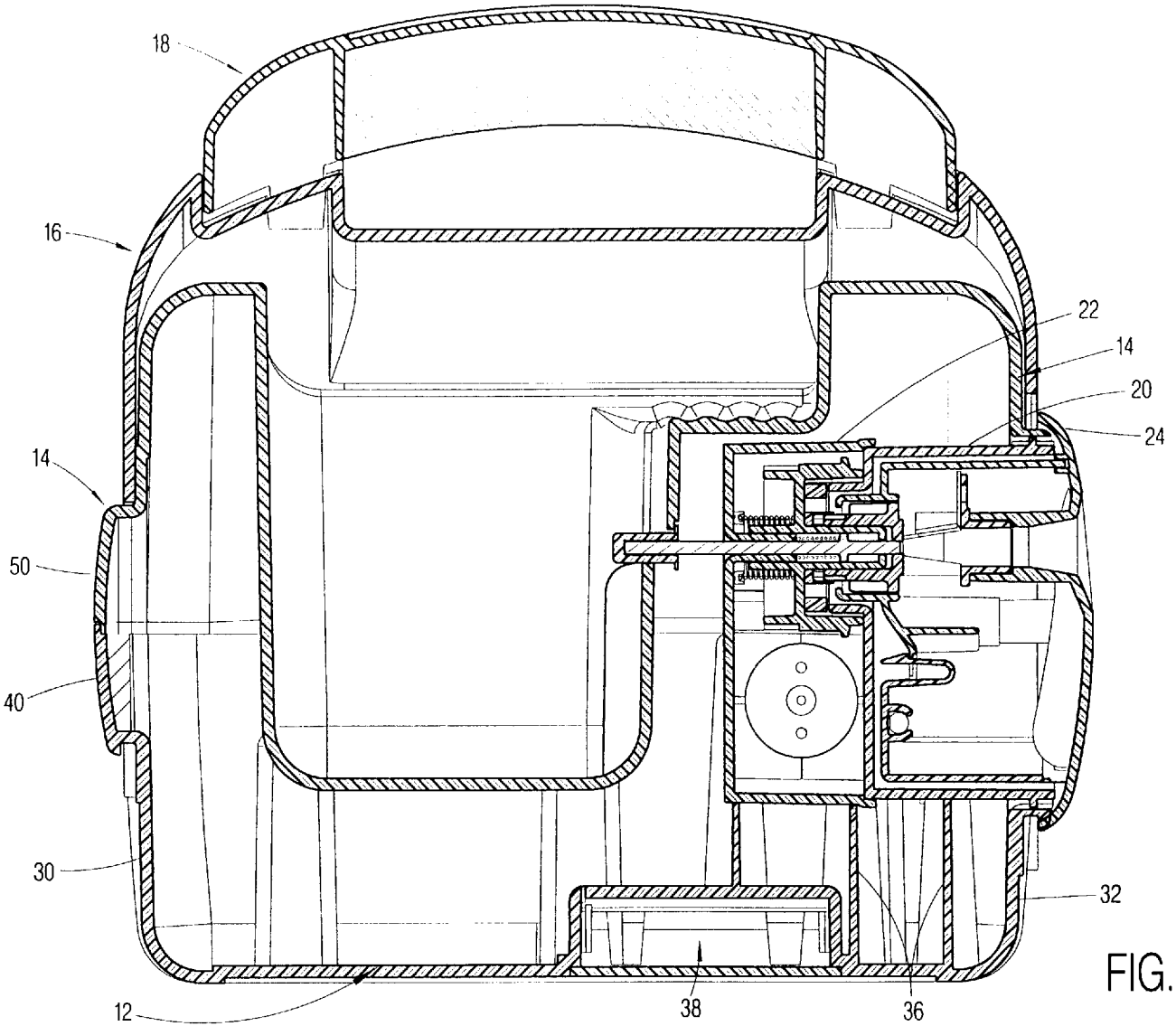
FIG. 4 is a longitudinal section view through the sharpener taken along the line 4—4 of FIG. 3.

Referring initially to FIGS. 1, 2, and 4, the subject sharpener assembly 10 is seen to comprise a lower housing 12, an upper housing 14, a lid 16, a handle 18, a cartridge module 20, a gear box housing 22, and a cover plate 24. The assembly 10 combines to form a hand carried portable crayon storage container having an integral battery powered crayon sharpener built therein.

The four sided lower housing 12 is molded from conventional plastics material by conventional means, and is defined by sidewalls 26, 28, and end walls 30, 32 projecting from a bottom floor surface 29 to an upper rim 31. Extending upward from within the housing, proximate the four comers, are four assembly sockets 34, each having an upwardly opening axial bore 35. A series of three parallel spacer walls 36 project upward from the floor 29 and include upwardly concave upper edges 37. A bottom opening battery compartment 38 extends into the floor 29 as shown.

Formed within the end wall 30 at the top rim 31 is a semicircular pivot pin flange 40. Across from the flange 40, extending into the top rim 31 of the opposite end wall 32 is a semicircular opening 42.

Figure 5:
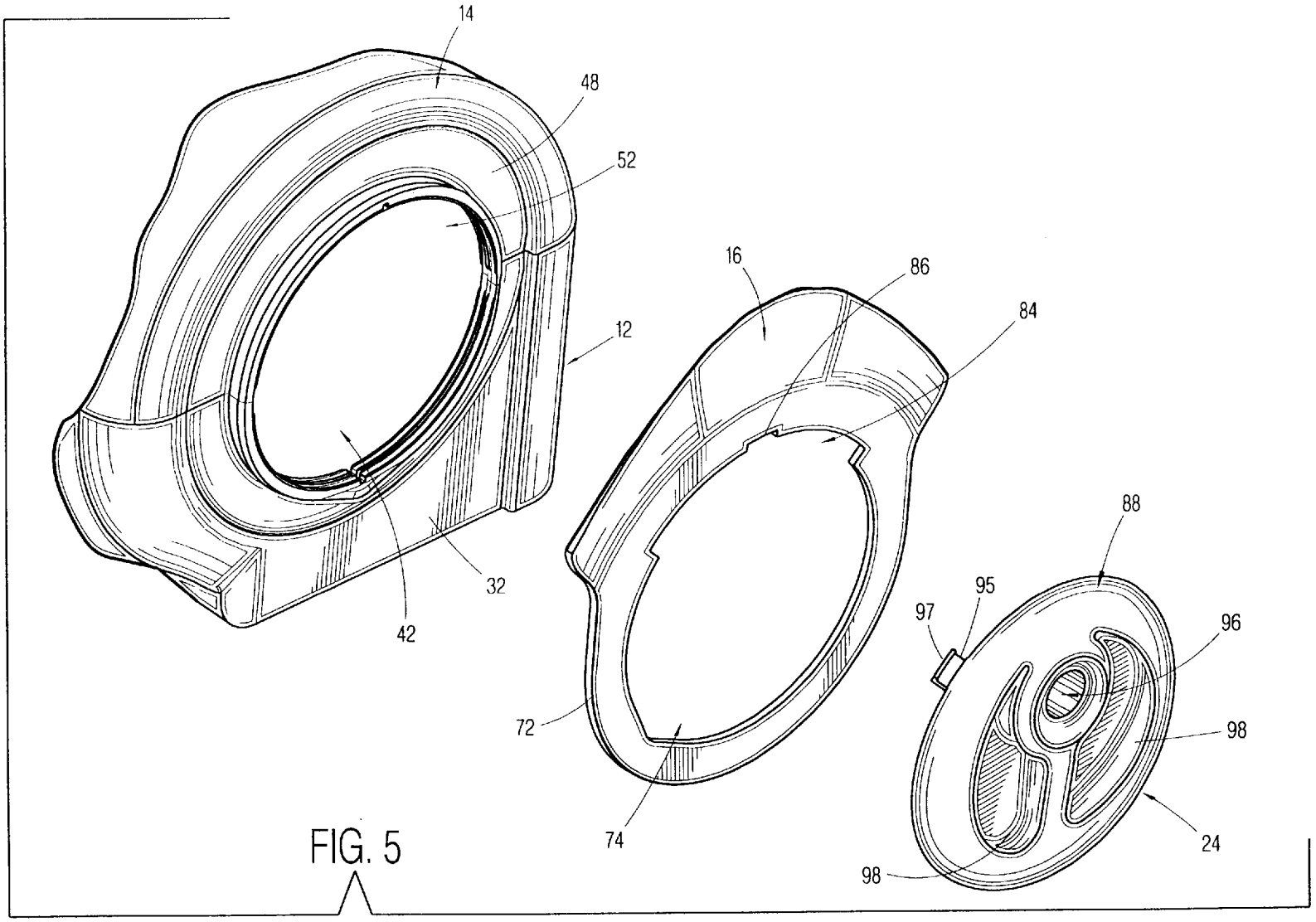
FIG. 5 is an exploded perspective view of the module cover plate and retention cap.

The upper housing 14 is a four sided plastic molded form, having sidewalls 44 and end walls 46, 48. A semi-circular pivot post flange 50 projects outward form end wall 46 and extending upwardly into the opposite end wall 48 is a semi-circular opening 52 (FIG. 5). The housing 14 further includes an inner storage compartment 54 and a raised platform at one end of the compartment 54 that is formed to provide adjacent crayon holding channels 56. A through-bore 58 exists through the vertical wall 55 of the raised platform as shown.

The lid 16 is a concave body 60 formed from plastic by conventional means. The body 60 merges at opposite ends with raised shoulder portions 62, each having a handle socket recess 64 formed downward therein and a through slot 66 extending downwardly through the lid to an underside. The lid is configured to have an end flap portion 68 through which a circular hole 70 extends. The opposite lid side is formed having a larger end flap portion 72 through which a larger circular hole 74 extends.

The handle 18 is an elongate plastic form having a central grip portion 76 of inverted U-shaped cross-section, defined by side surfaces 78. Four dependent rectangular retention tabs 80 extend from the side surfaces 78, each having a locking flange 82 at a lower free end.

The components 12, 14, 16, 18, 20, 22, and 24 fit together to form the assembly shown in FIG. 1. The cartridge module and gear box housing 22 are cylindrical cans of plastic construction that are supported by the arcuate edges 37 of the lower housing support walls 36. So located, the locking cover 24 is adjacent the end wall 32. The upper housing attaches to the lower housing and includes like-shaped downwardly directed edges (not shown) that, with edges 37, encircle and entrap the components 20, 22. The upper housing further has dependent posts (not shown) that extend from an underside into the bores 35 of the support posts 34, whereby connecting the housings 12, 14 together.

So joined, the flanges 40, 50 of the housings 12, 14 form a circular pivot post extending outward from on end of the assembly, and the openings (FIG. 5) 42, 52 of the housings 12, 14 at the opposite end form a circular opening that communicates with an internal chamber defined by the components 12. 14. The lid is pivotally connected to the upper housing 14 by the placement of flap through hole 70 around the pivot post formed by flanges 40.5 0. and flap through hole 74 around the circular opening formed by the openings 42, 52. Pivotally mounted lid 16 encloses the storage compartment 54 of the upper housing 14, and moves along an arcuate path between open and shut conditions. The handle 18 snaps into the upper sockets 64 of the lid 16, as tabs 80 project downward through lid slots 66 and the locking flanges 82 catch over an underside edge of the slots 66. The handle can then be used to transport the container or to rotate the lid into an open position.

With reference to FIGS. 2, 4, 5, and 7, it will be seen that the end flap 72 of the lid 16 is formed having an arcuate cutout channel 84 along the top perimeter hole 74. Intermediately positioned along the channel 84 is a rectangular notch 86. The notch 86 operates as a keyway for facilitating the removal of the cartridge module from the container as will be explained below.

The lock cover 24 is of a concave dish shape, having a radiussed outer wall 88. A slot 90 projects rearward from the outer wall 88 at the top, and a lip 92 projects rearward from wall 88 at the bottom. Proximate the slot 90, a cylindrical sleeve 94 projects rearward and throughbore 96 projects through the sleeve 94 from an outward surface of the wall 88. A rectangular alignment tab 95 projects outward from the peripheral edge of wall 88 and includes a locking flange 97 at the remote end thereof. Finger depressions 98 extend into the outward facing surface of the wall 88 to facilitate manual grasping and turning of the cover 24.

Figure 6:
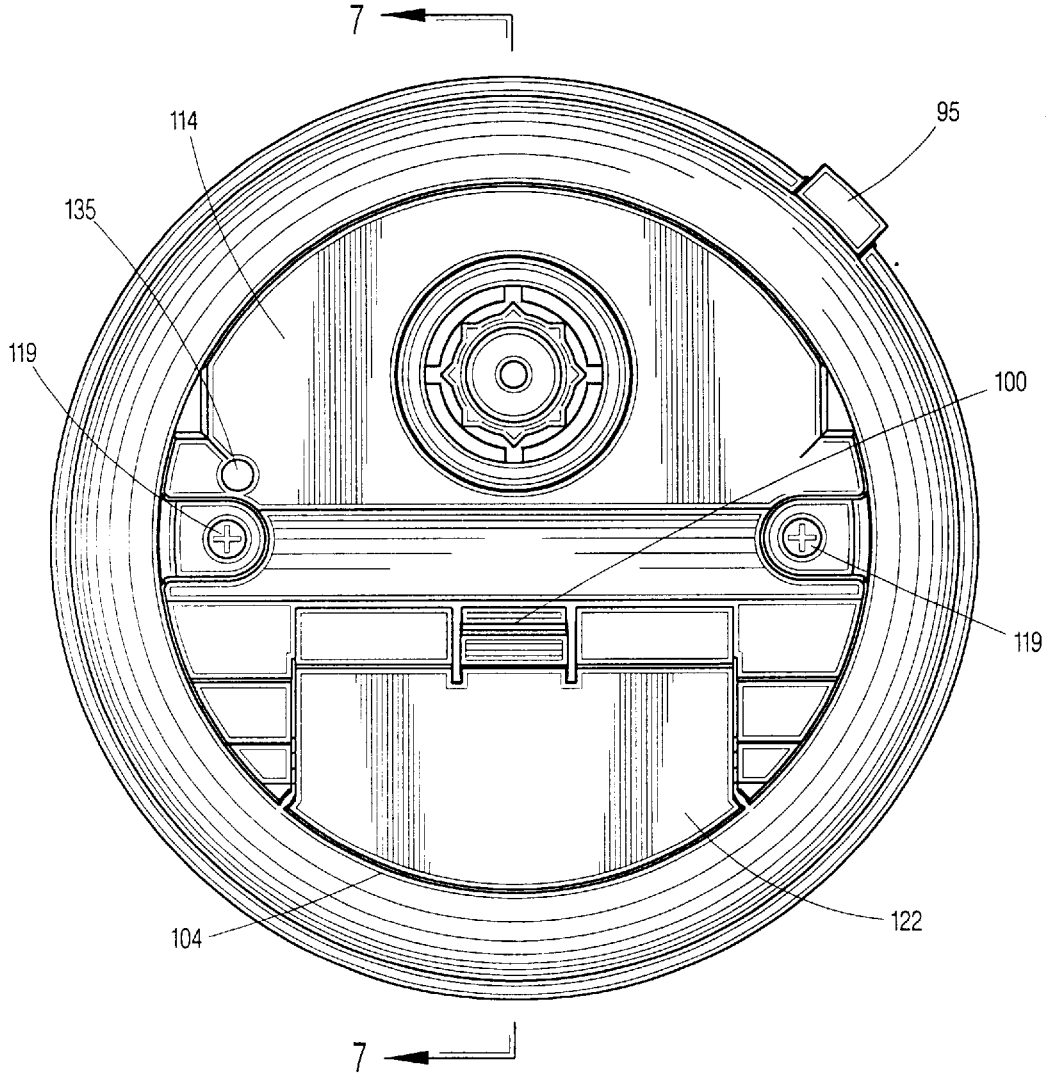
FIG. 6 is a planar inward end view of the cartridge module.
Figure 7:
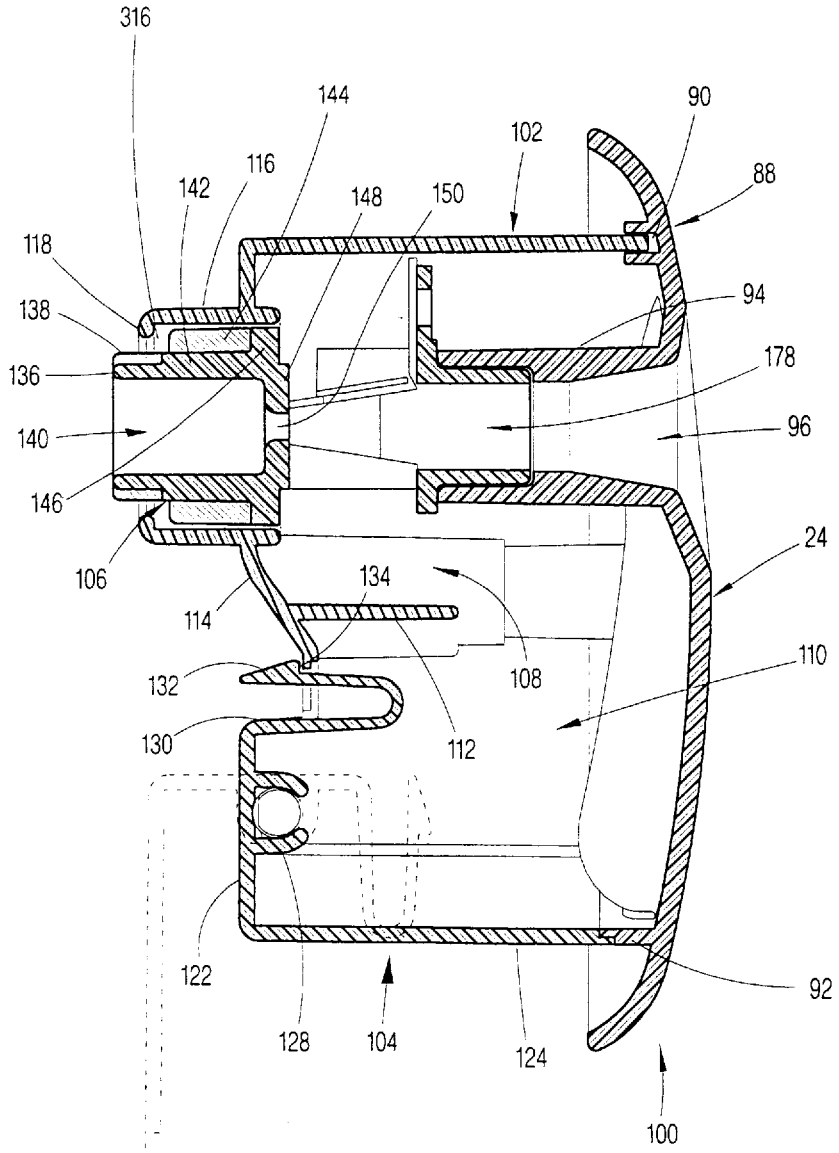
FIG. 7 is a longitudinal section view of the cartridge module taken along the line 7—7 of FIG. 6.
Figure 8:
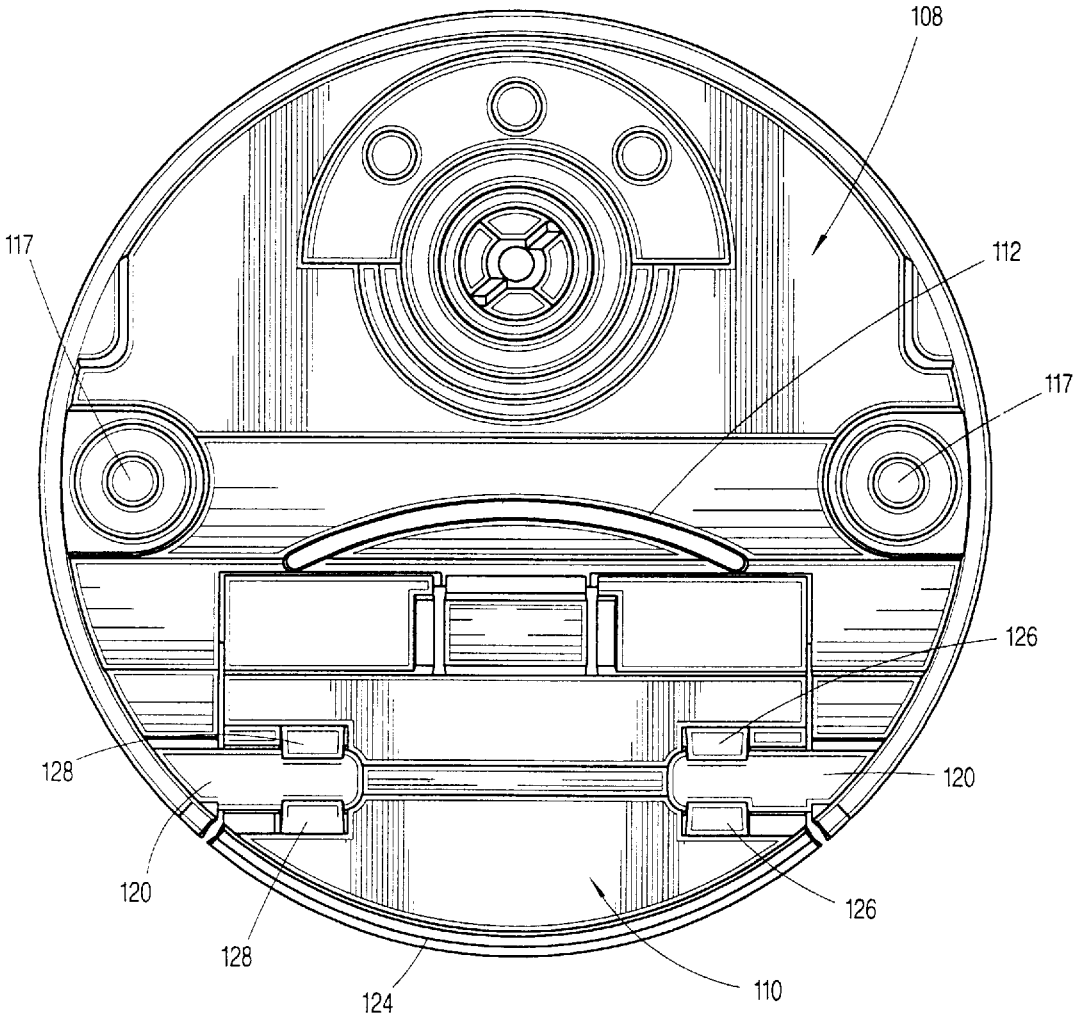
FIG. 8 is a planar outward end view of the cartridge module with the cover plate removed.

Continuing, with reference to FIGS. 5, 6, 7, and 7, the subject crayon sharpening incorporates a removable cartridge module 100 that comprises a drawer housing (102, a pivotal drawer door 104, and a cartridge block 106. The drawer housing 102 is of plastic construction having an internal upper chamber 108 and a lower, shavings collection chamber 110, with chambers 108, 110 being separated by a horizontally extending, downwardly concave partition flange 112. The housing 102 has a forward wall interrupted by a forwardly projecting cylindrical sleeve 116 proximate a top end. The sleeve has forward ends 118 inwardly formed as shown. The cover 24 attaches to the housing 102 by two screws 119 as shown in FIG. 6 that fit into two counter bored bosses 117 (FIG. 8) on the drawer housing and into two screw bosses (not shown) in the rearward facing surface of cover 24 .

A pair of spaced apart cylindrical pivot pins 120 extend from the sides of the drawer housing into the lower chamber 110 thereof. The door component 104 is of plastic construction, preferably transparent, and comprises a forward wall 122 and a bottom wall 124 connected at a right angle. The door has a pair of pivot post sockets 126, 128 formed and located to capture the pivot posts 120 therein, making the door reciprocally rotatable about the posts 120. A latch 130 of U-shape configuration is provided having a reversely formed upper free end 132 and a locking flange 134 extending thereacross. The latch flange 134 catches over the lower edge of drawer housing front surface 114 to lock the door component 104 in an upright condition, below the upper chamber 108.

The door 104 can be freed to rotate clockwise by compressing the latch 130 sufficiently to enable free end and flange 132. 134 to clear the lower edge of the front wall 114. So freed, the door can rotate clockwise into an inverted condition, whereupon the shavings contents accumulated upon the door in an upright condition will be expelled. The phantom lines of FIG. 7 depict the inverted state. Thereafter, the door can be rotated counter clockwise until latch end 132 and flange 134 snap back over the lower end of wall 114. Thus, the drawer readily and conveniently can be emptied and returned to its original state. It will be appreciated that the cartridge module 100 shown in FIG. 7 is a self-contained assembly that is transportable by grasping the cover 24. Also, it will be noted that the cover 24 attaches to the outward edge of the housing 102 by means of two screws 1 19.

Figure 20:
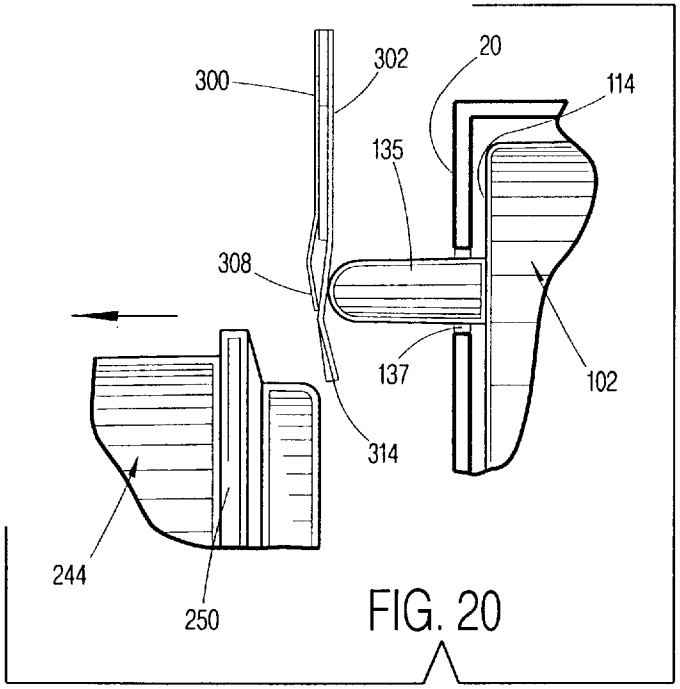
FIG. 20 is an exploded side elevation view of the drive and cartridge housing shown with the electrical motor contacts in the engaged position.
Figure 19:
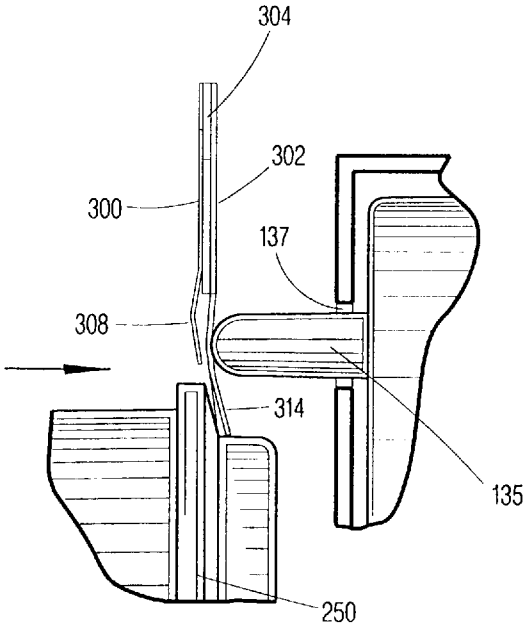
FIG. 19 is an exploded side elevation view of the drive housing, electrical motor contacts, and the cartridge housing, shown with the contacts in the disengaged position.

A protrusion 135 of elongate cylindrical configuration and having a rounded remote end, extends rearward from the housing surface 114 through an aperture 137 in module housing 20 as will be appreciated from FIGS. 6, 19, and 20. The protrusion 135 functions to apply a biasing force to the motor actuating contacts as will be explained below.

As seen from FIGS. 4, 7, 9, and 10, the cartridge block 106 seats lengthwise within the upper chamber 108 of the drawer housing 102. The block 106 comprises a cylindrical rearward sleeve 136 having conical outwardly projecting annular gear teeth 138 therearound and bore 140 therethrough; an intermediate larger diameter sleeve 142 adjoining the forward sleeve 136 and having a series of spaced apart retention ribs 144 therearound and extending lengthwise along the sleeve 136; and an outwardly directed semi-circular retention flange 146 at a forward edge of sleeve 136. Internally, the bore 140 terminates at an inward partition wall 148, and an aperture 150 that is coaxially aligned with the bore 140 proceeds through wall 148 to the forward side thereof.

A cutting station generally referenced at 152 exists forward of partition wall 148. The cartridge block 106 includes a central planar surface 154 extending forward from the flange 146, through which a centrally disposed elongate opening 156 extends. Opposite sides of tile opening 156 comprise cutting blade edges 158, 160 that converge from a forward end to a rearward end of the station 152. The central planar surface 154 is flanked on both sides by sidewalls 162,164, and extends forwardly to a vertical, semi-circular mounting, flange 166. A blade supporting pedestal 168 is positioned upon the surface 154 in abutment with the flange 166. The flange 166 has three apertures 170, 172, and 1 74 therethrough and a fourth aperture 173 extends through the surface 154 to one side of the central opening 156.

A forward cylindrical sleeve 176 extends from the flange 166 to a forward end of the cartridge block; the sleeve 176 having a coaxial bore 178 extending from the forward end of the cartridge block backward to the inner partition wall 148 as best seen in FIG. 7. The bore 178 has a rearward end portion that extends through the cutting station 152 and is of circular dimension in cross section, diametrically sized to closely admit a standard sized crayon.

A secondary blade 180 is provided that has a flat, horizontally oriented body 1 82 and a beveled cutting edge 184 that projects into the bore 178 and is oriented offset from yet parallel to the major axis of the cartridge block bore 178. The blade body 182 has a central through aperture 186. A preparatory blade 188 is further provided that has a flat, vertically oriented square shaped body 190 and a lower cutting edge 192 that extends into the bore 178 and is oriented transverse to the major axis of the cartridge bore. The body 190 has a step 194 formed in a lower comer adjacent to the cutting edge 192 and a centrally disposed through aperture 195.

A blade retainer 196 is provided having a flat elongate center portion 206; stepped end portions 198, 200, and central mounting apertures 202.204 extending through portions 198. 200. A horizontal cantilever flange 208 extends forward from an upper edge of portion 206 and a horizontal cantilever flange 210 extends rearward from a lower edge of portion 200. Flange 210 has a downwardly formed free end 212. Four assembly eyelets 214 are provided. Each having a circular head 216 and a central cylindrical shank projecting therefrom.

Assembly of the blades to the cartridge block will be understood from FIGS. 10, 11, 13, and 14. The blade 180 is positioned upon the cartridge block surface 154 with the flat forward edge of the blade against the flange 166, the aperture 186 in alignment over the aperture 173, and the side facing edge of the blade 180 against the sidewall 164. So positioned, the cutting edge 184 projects into the axial bore and bevels outwardly therefrom toward the rear of the cartridge block surface 154. A forward portion of the cutting edge 184 projects forward beyond the forward end of the cutting edges 158, 160. The cutting edge 184 is parallel to and offset from the central axis of bore 178. One eyelet 214 is inserted through aligned apertures 186,173 to secure the blade 180 to surface 154.

The blade 188 is likewise assembled to surface 154, with the forward facing side of body 190 abutting the flange 166, step 194 brought to rest upon the support 168, and aperture 195 aligned over aperture 172. The lower cutting edge 192 depends into the upper portion of the axial bore and is oriented perpendicular to the axis of the axial bore. One eyelet 214 extends through apertures 195, 172 to secure blade 188 to surface 166.

The blade retainer 196 provides means for attachment of the blades 180, 188 to the surface 154. The retainer 196 is positioned upon the surface 154 with the tab 212 inserted down into the eyelet 214 within apertures 186, 173, and retainer tab 208 projecting through the aperture 172 of flange 166. At the opposite end of the retainer, center portion 206 overlaps the blade 188 and the flange 166, and apertures 202 and 170 are in alignment and receive one eyelet 214 to secure the retainer 196 to the cartridge block. The final eyelet is inserted through aligned apertures 204 of the retainer and 174 of the flange 166. The retainer and the eyelet serve as mutually redundant connections for attachment of the blades 180, 188 to the cartridge block. Together, the retainer 196 and eyelets 214 ensure that the blades 180. 188 will not move through use from their intended positions on surface 154, 166.

Figure 10:
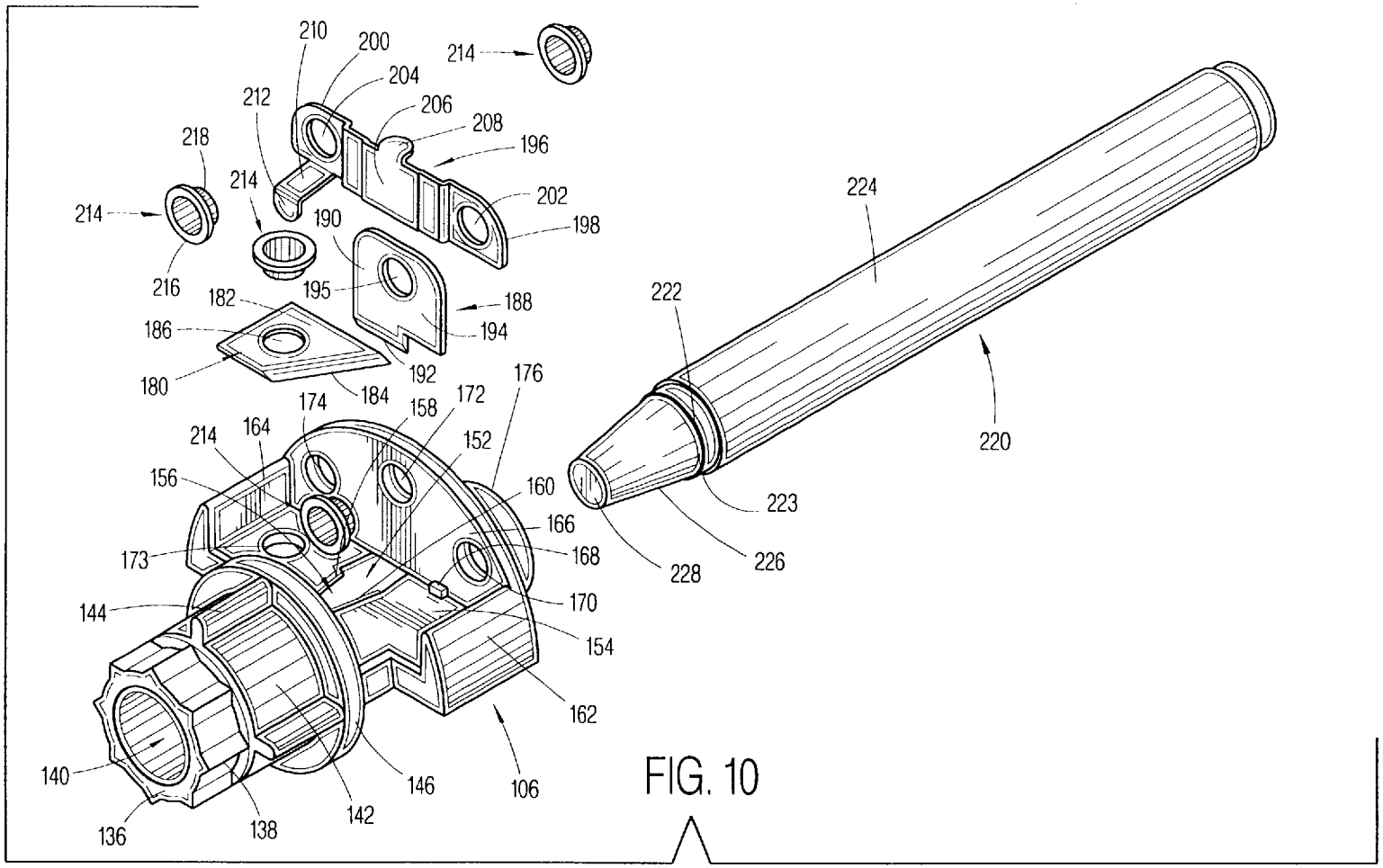
FIG. 10 is an exploded perspective view of the cartridge block and blades and a representative crayon.
Figure 11:
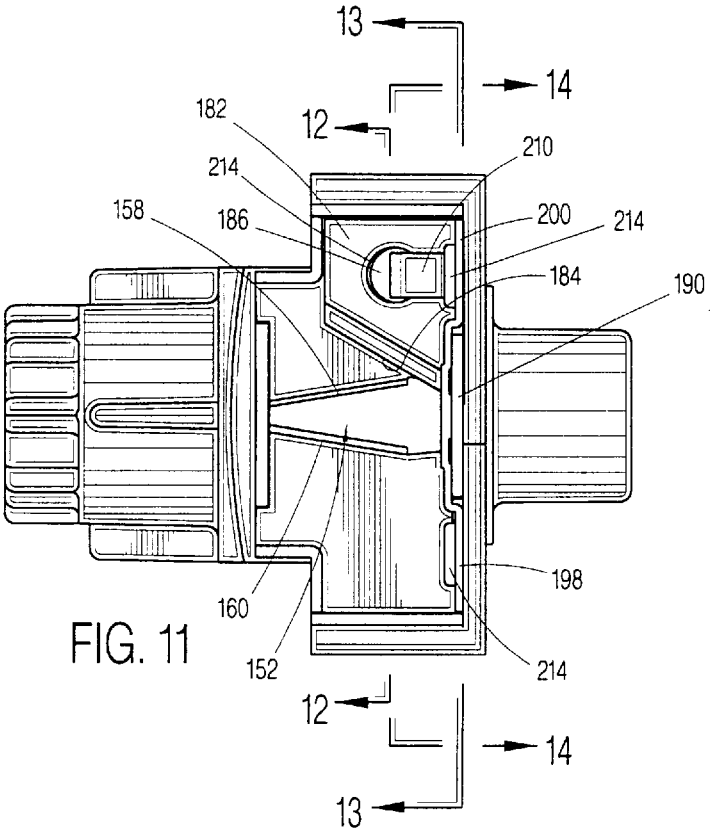
FIG. 11 is a top plan view of the assembled cartridge block.
Figure 12:
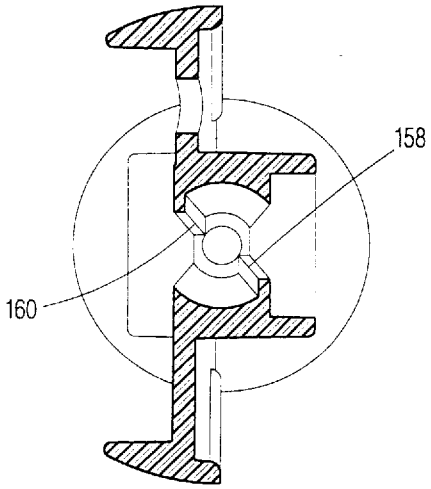
FIG. 12 is a transverse section view through the cartridge block, taken along the line 12—12 of FIG. 11.
Figure 13:
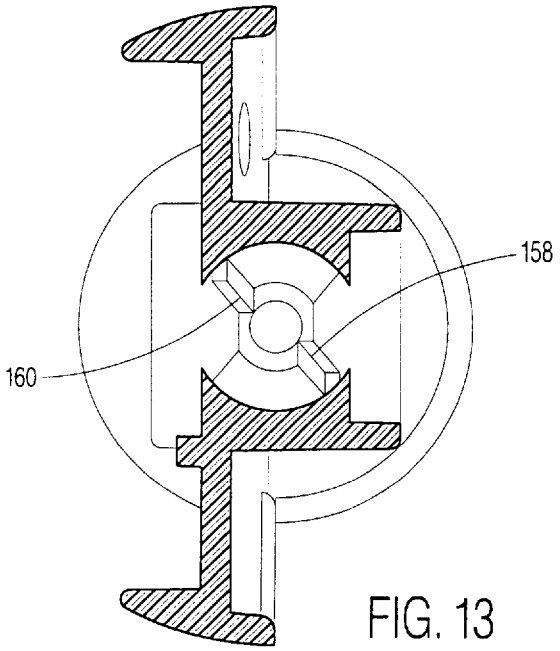
FIG. 13 is a transverse section view through the cartridge block, taken along the line 3—13 of FIG. 11.
Figure 14:
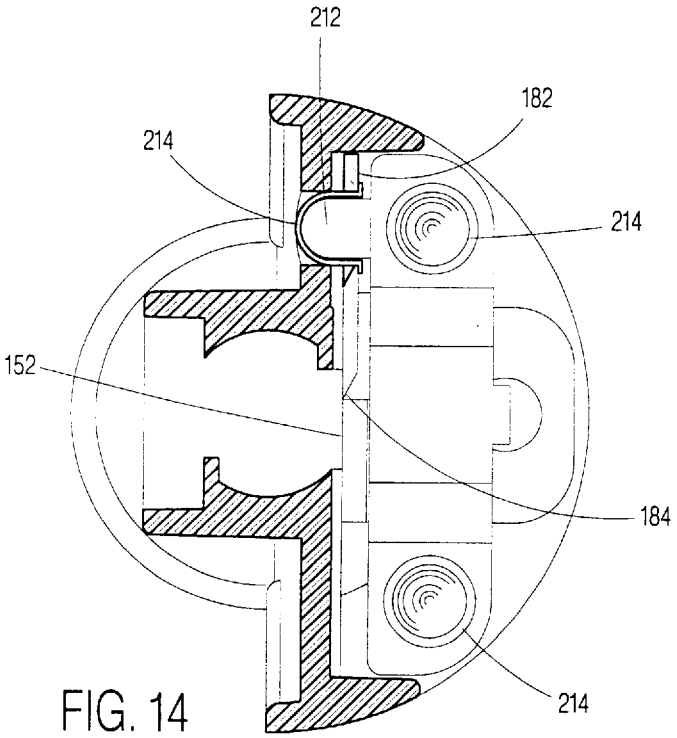
FIG. 14 is a transverse section view through the cartridge block, taken along the line 14—14 of FIG. 11.
Figure 15:
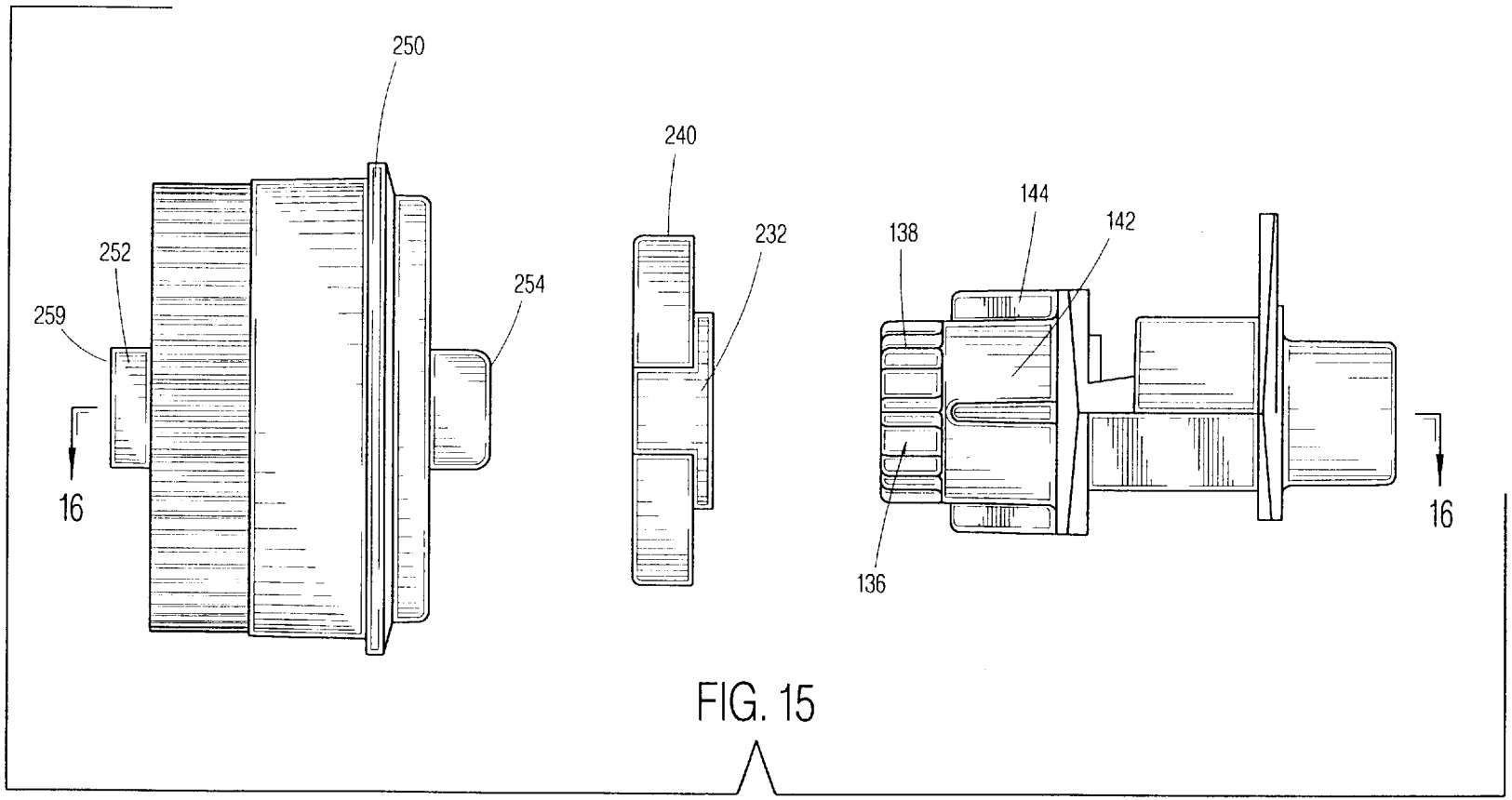
FIG. 15 is an exploded side elevation view of the cartridge block, clutch collar, and drive housing.
Figure 16:
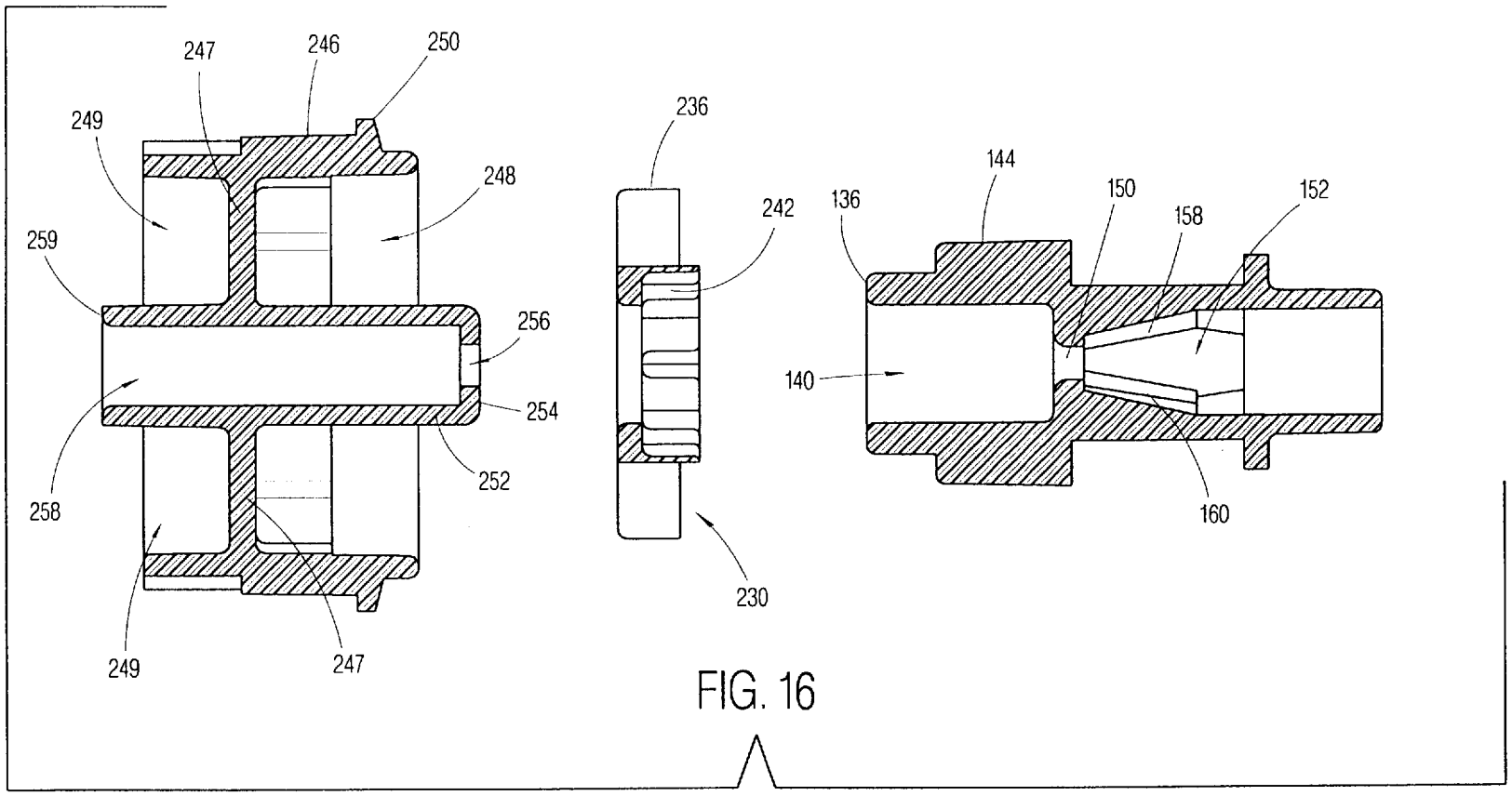
FIG. 16 is a longitudinal section view through the assembly of FIG. 15, taken along the line 16—16.

The assembled cartridge block, retainer, and blades, are received within the cartridge module 100 as will be appreciated from a combined consideration of FIGS. 7 and 10. The cartridge block 106 assembles from the forward end of the drawer housing 102, residing in the upper chamber 108 thereof. Upon insertion of the cartridge block 106, the intermediate sleeve 142 of the block 106 resides within the cylindrical socket 116 of housing 102, and the sleeve 136 projects from the rearward housing end 118 with clearance. It will be noted that the gear teeth 138 of sleeve 136 are spaced inward from the housing end 118 and that a circumferential gap exists about the block sleeve 136. The retention ribs 144 of block sleeve 142 extend into close proximity to the sidewalls of socket 116 and cannot clear the inwardly formed end 118 to thereby prevent the cartridge block from exiting the rearward end of the drawer housing 102.

The cylinder sleeve 94 of the cover member 24 captures the forward sleeve 176 of the cartridge block 106 therein with nominal clearance as shown. Spanning the upper chamber 108, the cartridge block is free at both ends and along its intermediary length to rotate about the longitudinal axis thereof. The bore 178 of the block 106 coaxially aligns with the bore 96 of the cover member 24. The distance between the forward end of the bore 178 and the inner partition wall 148 at the rearward end of the cutting station 152, and the diameter of the coaligned bores 96, 178 are designed to accommodate the axial receipt of a standard crayon therein.

As depicted in FIG. 10, a crayon 220 of the type commonly used is manufactured by a molding process to include an inner cylindrical core of colored wax, plastic, or the like 222. An outer jacket 224 of paper or plastic, and a frustroconical nose 226 that terminates at a circular nose end surface 228. The crayon end surface 228 is ideally suited for coloring in that it applies a relatively wider band of color with each stroke that achievable with a sharpened point.

Referring to FIGS. 4, 9, 15, 16, and 17, a clutch collar 230 is shown having a cylindrical body 232; a throughbore 234 extending through body 232; a pair of diametrically opposite peripheral arched flanges 236, 238; and a radiussed lobe projection 240 directed outward from each flange 236, 238. The internal surface of the body 232 includes an annular ring of gear teeth 242. A cylindrical drive housing 244 is configured having a main body 246 and a frontal annular bore 248 extending inward into the body 246 to an internal partition wall 247. An annular rearward bore 249 is provided on the rearward side of wall 247 and extends rearward to a rearward end of body 246. An outwardly projecting annular flange 250 extends about body 246 proximate the forward end thereof. An axial sleeve 252 extends through the body 246, with a forward sleeve end 254 projecting beyond the forward end of body 246 and a rearward sleeve end 259 projects beyond the rearward end of the body 246. An aperture 256 extends through the forward sleeve end 254 and an axial through bore 258 extends through the sleeve 252 from the rearward end 259 to the forward end 254 and communicates with the aperture 256.

A ring of internal annular gear teeth 260 circumscribe an inner wall of the housing 244 in the forward bore 248 and a ring of outward directed annular gear teeth 262 circumscribe the outer surface of the housing 244 proximate the rearward housing end.

A circular ring 264 is positioned within the rearward bore 249, having a body 265 and a throughbore 266. The ring body 265 has an annular forward facing channel 268 adapted to receive and seat a helical compression spring 270 and to press the spring against the internal surface of chamber 249. An ejector pin 272 is shown to comprise a forward segment 274 terminating at a circular forward end surface 275; an annular retention collar 276 positioned axially rearward of the forward segment 274; an elongate main body segment 278 terminating at a rearward end 280. A helical compression spring 282 receives the rearward end 280 therethrough and is positioned against the forward collar 276. An end cap 284 having a central socket 286 receives the rearward end 280 of the ejector pin 272 therein to prevent separation of the spring 282 therefrom.

Figure 9:
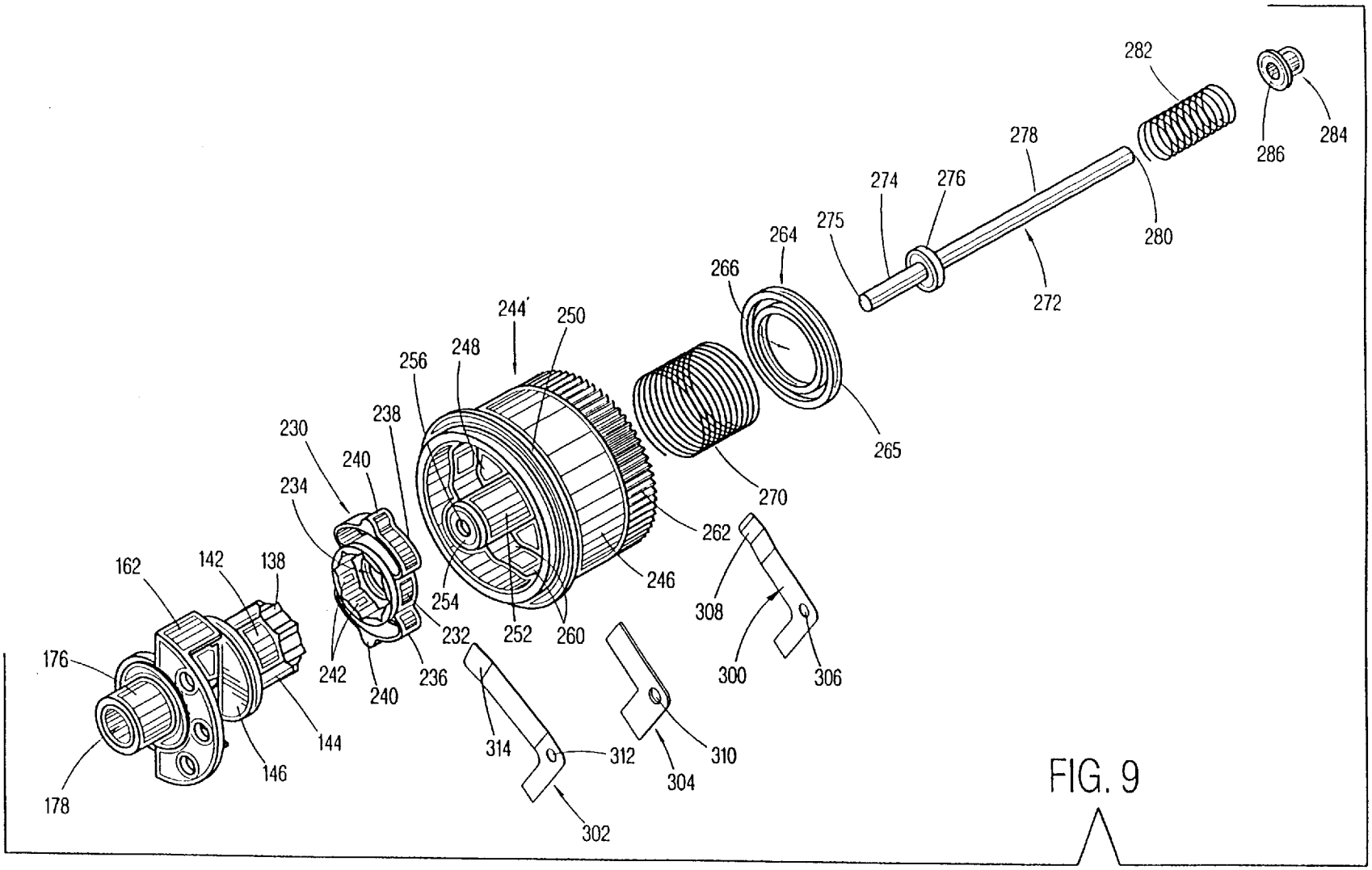
FIG. 9 is an exploded perspective view of the ejector pin, drive housing, clutch collar, cartridge block, and motor controlling contacts.
Figure 18:
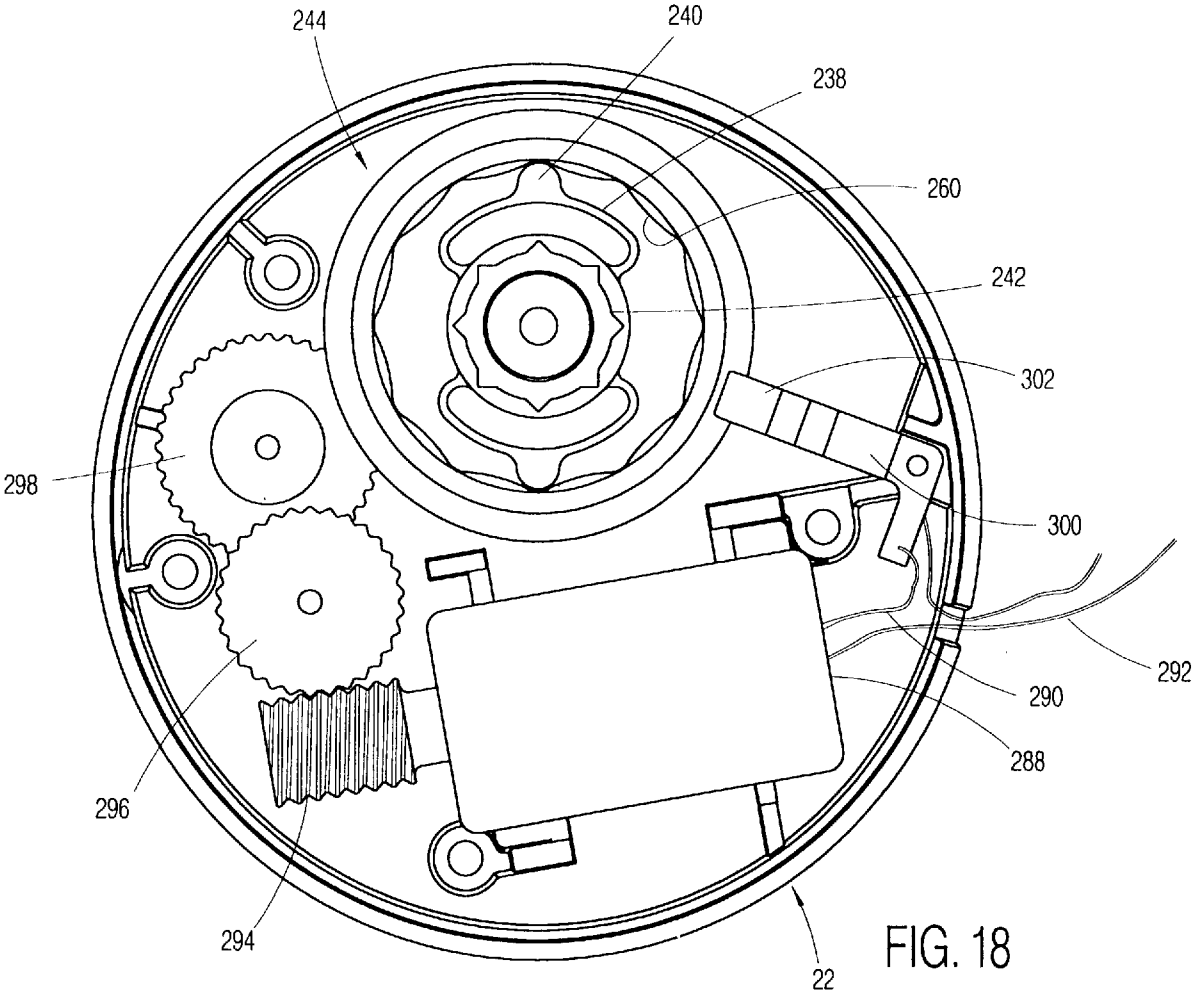
FIG. 18 is a plan view of the motor and drive train assembly.

Referring to FIGS. 2, 9, and 18, a motor 288 is mounted to the gear box housing 22 and lead 290 electrically connects the motor 288 to contact 300 and lead 292 goes from the motor to the battery compartment 38. Motor 288 is a conventional drive motor that is common in the industry and operates on 4 "AA" alkaline batteries that are stored and electrically connected with the compartment 38. The electric motor 288 drives a worm gear 294 that meshes with and drives a combination gear 296. The gear 296 in turn meshes with and drives a spur gear 298 that engages and drives the outward gear teeth 262 of the drive housing 244. The gear train described above thus mechanically rotates whenever the motor 288 is actuated and rotational movement of the drive housing 244 stops whenever the motor 288 is deactivated.

The switching of motor 288 between the on and off modes occurs via two separate electrical contacts 300 and 302 that are positioned adjacent to one another but electrically isolated by an insulation spacer 304. Contact arm 300 is L-shaped and includes a mounting aperture 306 and a remote contact tip 308. The spacer 304 is likewise L-shaped and includes an aperture 310; and L-shaped contact arm 302 is provided with mounting aperture 312 and includes a remote contact end 314.

Figure 17:
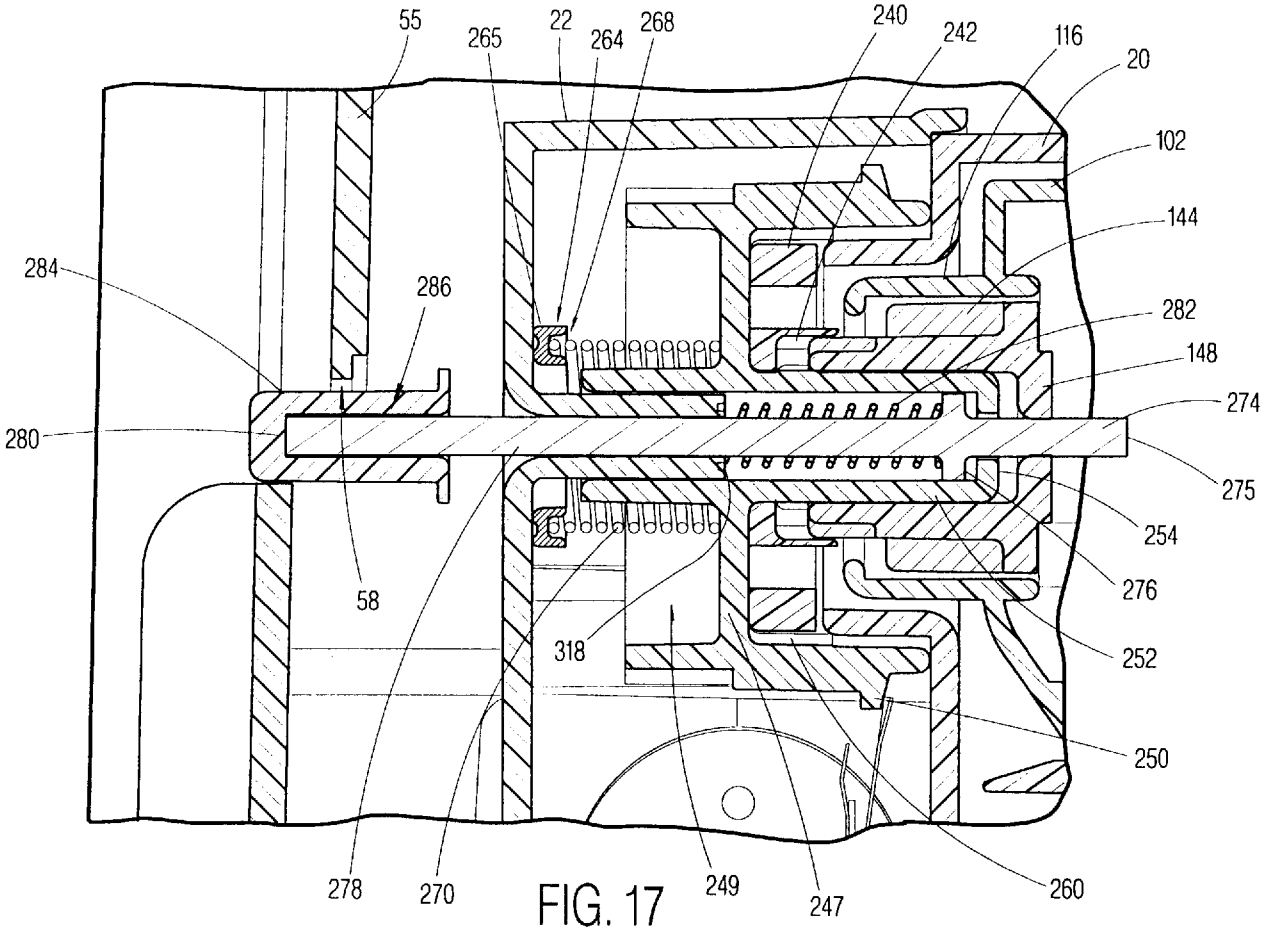
FIG. 17 is a longitudinal section view through the assembled drive housing.

The position of the contact arms relative to the drive housing 244 will be understood from FIGS. 9, 18, 19, and 20. The contact arm 302 is longer that the contact arm 300 and the remote end of arm 302 is positioned forward and adjacent to the peripheral flange 250 of the drive housing 244. The protrusion 135 of the drawer housing 102 projects from surface 114 through an aperture 137 in the cartridge housing 20 and presses against the contact 302, biasing the contact 302 against contact 300. Whenever the drive housing is in the rearwardly biased position, as shown in FIG. 20, the spring 270 is compressed, and the contact end 308 of contact arm 300 is in electrical contact with the contact arm 302 and a circuit is established therethrough which activates the drive motor 288. However, when in the forward, or released position, as depicted in FIG. 17 and 19, spring 270 will exert a forward force and move the drive housing 244 forward and flange 250 of the housing will contact and force the remote end 314 of contact 302 forward, whereby breaking electrical contact between the contacts 300, 302, and disabling the motor 288. The force exerted by housing 244 against contact end 314 causes end 314 to resiliently flex about the remote end of protrusion 135, breaking the connection with contact 300. As will be explained below, the housing 244 moves axially rearward responsive to a crayon inserted into the cartridge block to activate the motor and returns to a forward axial position in the absence of a crayon to deactivate the motor 288.

With reference to FIGS. 4, 7, 9, and 17, the operation of the subject sharpener will be explained. The clutch collar 230 is coaxially seated within the drive housing 244, with the housing center sleeve 252 projecting through the clutch collar 230 and the inward gear teeth 260 of housing 244 meshing with the lobe projections 240 of the clutch collar. The gear teeth 262 of the housing 244 mesh with the drive gear train as described above. The housing 244 reciprocates axially along the ejector pin 272 between a forward position, shown in FIG. 17, in which compression the spring 270 is relaxed and exerts no biasing force on the housing 244, and a rearward position in which the compression spring 270 is compressed against the inward surface of housing 22.

The cartridge block 106 is rotationally seated within the removable cartridge drawer assembly 100. As the assembly 100 is inserted into the cartridge module 20, the leading end of the cartridge block sleeve 136 enters into the clutch collar 230 and a leading portion of the cartridge block gear teeth 138 mesh with the internal gear teeth 242 of the clutch collar. The cartridge block 106 reciprocates axially along the major axis of the housing, cylindrical socket 116 a small distance indicated in FIG. 7 at 316. Axial movement in the rearward direction is initiated when a crayon 220 is inserted axially into cartridge block bore 178 and a forward end of the crayon contacts sharpening edges 158, 160. Pushing the crayon inward causes the cartridge block forward gear teeth 13S further into the clutch collar teeth 242 and pushes the drive housing 244 axially rearward. Rearward movement of housing 244 causes spring 270 to compress, the peripheral flange 250 to disengage from the motor contact arm 302, and the contacts 300 and 302 to re-engage. With the re-engagement of contacts 300 and 302, motor 288 is activated and begins rotation of the housing 244 through worm gear 294, combination gear 296, and spur gear 298.

Rotation of housing 244 causes rotation of the clutch collar 230 as lobes 240 are rotationally driven by gear teeth 260. The rotation of clutch collar 230 in turn causes the cartridge block 106 to rotate about its longitudinal axis as clutch teeth 242 drive the cartridge block teeth 138. Rotation of the cartridge block 106 causes rotation of the sharpening blades 158, 160, 180, 188 relative to the forward nose of the crayon 220. The vertical blade 188 scores the circumference of outer jacket 224 proximate the forward end as it rotates, and the horizontal blade 180 initiates a horizontal annular cut into the forward end of the crayon as it rotates, stripping away the outside crayon jacket back to the cut made by vertical blade 188. Contemporaneously, the rotating blades 158, 160, oriented to converge from front edge to rearward edge, carve the nose portion 226 into a conical form. The shavings resulting from the cutting blades fall between the blades 158, 160 into the upper drawer chamber 108, thence onto the downwardly concave flange 112, and thereafter fall off into the lower drawer chamber 110 and onto the lower door panel 124.

The subject invention incorporates means for disabling the rotation of the cartridge block 106 whenever an article harder than a crayon, such as a pen or pencil, is inserted into the cartridge block bore by mistake. As will be appreciated from the configuration of the clutch collar lobes 240 and the drive housing internal gear teeth 260, shown in FIG. 18, rotation of the clutch collar by the drive housing will occur only at a relatively low torque loading level. A higher torque loading will cause the lobes 280 to slip over the housing gear teeth 260, preventing the rotation of the collar 230 and the cartridge block 106 therein. For example, if the cartridge block is loaded with a harder object such a pencil, a larger torque will be required to turn the blades 158, 160, 180, 188 against the object. However, the torque required to rotate the cartridge block 106 will exceed the preset torque limits designed into the clutch collar lobes 240 and rotation of the clutch collar and cartridge block will be inhibited. Thus, the subject sharpener incorporates a fail-safe mechanism for disabling the rotation of the sharpening blades against an object that is harder than the relatively soft crayon for which the sharpener was designed.

Removal of the crayon after it has been sharpened from the cartridge block releases earward pressure on the cartridge block 106 and drive housing 244, freeing spring 270 to direct a forward force on the housing 244 and cartridge block 106. Forward movement of housing 244 causes flange 250 to re-engage motor contact arm 302, separating it from contact arm 300, whereby breaking the motor circuit and deactivating the motor. Consequently, rotation of housing 244 terminates and with rotation of the cartridge block 106. Insertion of a crayon into the cartridge block 106 thus initiates rotation of the cartridge block by engaging the motor 288 and withdrawal of the crayon terminates the rotation of the cartridge block 106 by electrically breaking the circuit of the motor 288.

The contact between contacts 300 and 302 is also broken by the removal of the shavings drawer assembly 100 from the sharpener housings. As the assembly is withdrawn. The spring 270 causes the drive housing 244 to move axially forward, causing peripheral flange 250 to engage contact 302 and break electrical engagement between contact 302 and 300, whereby disabling the motor 288. Thus, removal of the drawer assembly 100 effectively disables the drive motor and prevents actuation of the drive assembly during its absence.

The manner of removal of the drawer assembly 100 will be appreciated from consideration of FIGS. 5 and 6. The cover 24 of the drawer assembly 100 is provided with the lock tab 95, located at approximately the ten o'clock position. The lid 16 of the sharpener has a channel 84 formed in a peripheral edge of the opening 74, and a notch 86 is located within the channel at the twelve o'clock position. In order to remove the drawer assembly 100, the lid 16 must be rotated until the notch 86 aligns with the cover member tab 95, whereupon the cover member 24 and the drawer assembly 100 may be pulled out of engagement with the sharpener case. Replacement of the drawer assembly occurs in reverse sequence. That is, the lid 16 must be rotated so that the notch 86 is in the ten o'clock position so that the drawer assembly cover tab 95 can be inserted therethrough. The lid 16 is thereafter rotated into an upright position and tab 95 is trapped against the inside surface of channel 84.

The removal of the drawer assembly 100 most frequently is for the emptying of shavings from the lower housing chamber 110. To effectuate removal, the latch end 132 is pushed down and in, causing the flange 134 to clear the lower end of wall 114. The lower door 104 can thereafter be rotated clockwise into an inverted position and its shavings contents emptied. It will be noted that with the door 104 open, the blade area of the cartridge block is digitally inaccessible because of the presence of flange 12. A child, therefore, cannot reach into the blade area and inadvertently be injured.

A second reason for removal of the drawer assembly 100 is to replace the blades 158. 160, 180, or 188. Also, if the forward end of the crayon breaks off during the sharpening procedure and cannot be dislodged by the ejector pin as explained below. The cartridge block can be accessed by removal of the drawer face 114 by the loosening of two captive screws (not shown) and freeing the cartridge assembly for replacement or cleaning.

The ejector pin 272 as seen in FIGS. 4, 7, and 9, extends through sleeve 252 of the drive housing 244 and the forward pin segment 274 projects through the aperture 256 in the sleeve end wall 254. The spring 282 is received over the ejector pin segment 278, and abuts the annular collar 276 at a forward end, and seats within an annular channel 318 at a rearward end. The rearward end 280 of the ejector pin projects through the through bore 58 within the wall 55 of the upper housing 14 and has end cap 284 secured thereover. As such, the end 280 of the ejector pin is digitally accessible from the storage compartment 54 of the upper housing 14.

The forward end 274 of the pin 272 extends through the sleeve end wall 254 and through the inner partition wall 148 of the cartridge block as shown in FIGS. 7, 9, 16, and 17. The forward circular end surface 275 of the pin 272 projects through end wall aperture 255 and into the cutting station 152. As the crayon is inserted into the cutting station 152 and is sharpened, the forward nose surface of the crayon will abut the forward end surface 275 of the pin 272 and take a circular form. The ejector pin 272 will be pushed by the crayon axially rearward, compressing the spring 282. After the sharpened crayon is removed, the spring 282 will force the pin 272 forward end surface 275 will push any residual crayon shavings or any small broken crayon pieces from cutting station 152 and they will drop out. If the pieces lodged in the cutting station 152 are of a larger size, the ejector pin may be forced axially forward by digitally pressing the rearward end 280 of the pin forward from within the storage compartment 54 of the upper housing 14. If that proves unsuccessful, the drawer assembly 100 can be removed and the cartridge block accessed and serviced.

From the foregoing, it will be appreciated that the subject invention functions to restore the forward tip of a crayon to its manufactured state. The outer jacket of the crayon is scored by the vertical blade 188, referred to as the preparatory blade, and the horizontal blade 180 lifts the paper and peels it away and in so doing cuts an annular shoulder 223 into the forward end. The convergent blades 158, 160 form a conical nose to the crayon and ejector pin forward end surface 275 gives the crayon tip a circular flat nose end surface that is optimal for coloring purposes. The blades 180, 188 are formed of steel for durability since repeated cutting through the jackets of crayons can dull plastic blades. The blades 158, 160 are of plastic construction since they encounter only soft core material.

The safeguards incorporated in the subject invention are apparent from the forgoing. First, the motor will be automatically engaged when the crayon is inserted into the cartridge block and therethrough forces the drive housing rearward. Removal of the crayon causes the motor to automatically disengage in reverse manner. Secondly, the insertion of a harder object, such as a pen or pencil, into the cartridge bore will cause the clutch collar to slip out or meshing engagement with the drive housing, whereby preventing the cartridge block blades from rotating against the harder object. The softer crayon, however, will not cause such slippage and the clutch collar will remain in engagement with the drive housing and be rotated thereby.

Thirdly, the subject motor is disabled by the removal of the drawer assembly 100, an additional safeguard. The drawer assembly further facilitates easy removal of shavings through a bottom dropping door and incorporates an internal flange to render the cartridge block blades inaccessible to fingers when the bottom door is open. Lastly, the subject invention incorporates a self-ejecting pin for dislodging broken crayon pieces from the cutting station.

While the preferred embodiment of the subject invention has been described above, the invention is not intended to be limited thereto. Other embodiments that will be apparent to those skilled in the art and which utilize the teachings herein set forth, are intended to be within the scope and spirit of the subject invention.

We claim:

1. A method for sharpening a crayon having a longitudinal axis, the method comprising the steps of:

inserting the crayon into a cartridge block having an axial bore;

positioning a forward end of the crayon in a forward end of the axial bore;

initiating relative rotational movement between the cartridge block and the crayon;

cutting the forward end of the crayon with at least one sharpening blade positioned to extend into the axial bore such that a first outer layer of the crayon is shaved off thus forming a conical nose into the forward end of the crayon; and cutting the forward end of the crayon with at least one secondary blade positioned conterminous to the conical nose of the crayon and extending parallelly to and into the axial bore such that a second outer layer of the crayon proximate the conical nose is shaved off thus forming a cylindrical collar conterminous to the conical nose.

2. A method according to claim 1, further comprising the step of scoring the forward end of the crayon with at least one preparatory blade positioned to extend normally relative to the longitudinal axis into the axial bore, said preparatory blade being rotated circumferentially around a peripheral surface of the crayon such that the forward peripheral surface adjacent the cylindrical collar of the inserted crayon is scored transverse to the longitudinal axis of the crayon.

3. A method for sharpening a crayon as recited in claim 1, further comprising the step of: collecting the first outer layer and the second outer layer in a receptacle, the receptacle comprising side and bottom walls defining an upwardly open collection reservoir and a bottom opening door such that the first outer layer and the second outer layer are expelled.

4. A method for sharpening a crayon having a longitudinal axis, the method comprising the steps of:

inserting the crayon into a cartridge block having an axial bore;

positioning a forward end of the crayon in a forward end of the axial bore;

initiating relative rotational movement between the cartridge block and the crayon;

cutting the forward end of the crayon with at least one sharpening blade positioned to extend into the axial bore such that a first outer layer of the crayon is shaved off thus forming a conical nose into the forward crayon end;

cutting the forward end of the crayon with at least one secondary blade edge positioned conterminous to the conical nose of the crayon and extending parallelly to and into the axial bore such that a second outer layer of the crayon proximate the conical nose is shaved off thus forming a cylindrical collar conterminous to the conical nose; and ejecting said first and said second outer layers retained in the axial bore with an ejector pin coaxially aligned with the inward end of the axial bore.

5. A method for sharpening a crayon as recited in claim 4, wherein the step of ejecting further includes the step of biasing the ejector pin toward the axial bore.

6. A method for sharpening a crayon as recited in claim 5, wherein the step of biasing the ejector pin includes urging the ejector pin toward the axial bore with a helical spring.

7. A method for sharpening a crayon having a longitudinal axis, the method comprising the steps of:

inserting the crayon into a cartridge block having an axial bore;

positioning a forward end of the crayon in a forward end of the axial bore;

initiating relative rotational movement between the cartridge block and the crayon;

cutting the forward end of the crayon with at least one sharpening blade positioned to extend into the axial bore such that a first outer layer of the crayon is shaved off thus forming a conical nose into the forward end of the crayon;

cutting the forward end of the crayon with at least one secondary blade positioned conterminous to the conical nose of the crayon and extending parallelly to and into the axial bore such that a second outer layer of the crayon proximate the conical nose is shaved off thus forming a cylindrical collar conterminous to the conical nose; and disabling the relative rotation movement between the cartridge block and the crayon with a disabling means when a predetermined torque load is exceeded.

* * * * *